United States Patent [19]

Salzmann

[11] Patent Number: 4,921,146

[45] Date of Patent: May 1, 1990

[54] SERVER TOP WITH SNAP-FIT PUSH LEVER

[75] Inventor: Ferdinand F. Salzmann, Praire du Sac, Wis.

[73] Assignee: Traex Corporation, Dane, Wis.

[21] Appl. No.: 208,064

[22] Filed: Jun. 17, 1988

[51] Int. Cl.[5] ..... A47G 19/14

[52] U.S. Cl. ..... 222/473; 222/470; 222/472; 222/474; 222/517

[58] Field of Search ..... 222/470, 473, 474, 472, 222/517

[56] References Cited

U.S. PATENT DOCUMENTS

| | | | |
|---|---|---|---|
| 486,298 | 11/1892 | Ricker | 222/517 |
| 1,976,426 | 3/1933 | Zisch | 222/556 X |
| 2,154,581 | 4/1939 | Pershall | 222/473 |
| 2,312,380 | 3/1943 | Berhardt | 222/517 |
| 3,201,011 | 8/1965 | Brocken | 222/473 |

*Primary Examiner*—Kevin P. Shaver
*Assistant Examiner*—Boris Milef
*Attorney, Agent, or Firm*—Quarles & Brady

[57] ABSTRACT

A server top which is attachable to a container, includes a lid portion which fits over the container and has an outlet through which a substance within the container may be poured, two substantially parallel side faces which each extend outwardly from the lid portion and which each have a pivot hollow, a closure which is movable over the lid portion to open and close the outlet, and a push lever. The push lever is connected to the closure to open and close the outlet by sliding the closure back and forth. The push lever includes a push arm, two sides of which a portion of each side is inwardly adjacent to one side face near its pivot hollow, two pivot protrusions which each extend outwardly from one push lever side into the adjacent pivot hollow so that the push lever is pivotally mounted between the two side faces. The entire push lever is injection molded as a unitary form finished push lever, with the push arm, two sides, and two protrusions formed in the same molding operation.

4 Claims, 2 Drawing Sheets

SERVER TOP WITH SNAP-FIT PUSH LEVER

BACKGROUND OF THE INVENTION

1. Field of the Invention

The present invention relates to tops of containers, more particularly to server tops which have a pivoting push lever for opening and closing an outlet through which fluid may be poured.

2. Description of the Prior Art

Server tops which have push levers for moving a sliding closure to open and close an outlet in the lid portion of the server top are commonly used on containers for syrups and other food condiments. These server tops generally include a lip portion with outlet, a sliding closure which slides over the lid portion to open and close the outlet, a handle portion with two parallel side faces which extend outwardly from the lid portion and a platform which together form a cavity, and a push lever which is mounted pivotably into the cavity and is connected to the sliding closure to selectively move the closure over the lid portion. The push lever is generally press-formed from a metal sheet, and includes a push arm which is pushed for pivoting the push lever away from the outlet, and two sides which extend downwardly from the push arm, each side being inwardly adjacent to one of the handle portion side faces. Each push lever side and each handle portion side face has a hole therethrough so that when all four holes are aligned, a pivot pin may be inserted therethrough to pivotally mount the push lever within the cavity. A coil spring is generally mounted on the pivot pin between the push arm sides to bias the push arm toward the outlet so that the connected closure closes the outlet unless the push arm is pressed by the user. One end of the pivot pin generally has a head which helps to maintain the pin within the holes. After insertion, the other end of the pin usually is pressed or beaten to expand so that the pin is permanently retained within the holes.

SUMMARY OF THE INVENTION

The present invention is summarized in that a server top which is attachable to a container includes a lid portion which fits over the container and which has an outlet therethrough through which a substance within the container may be poured, two substantially parallel side faces which each extend outwardly from the lid portion and which each have a pivot hollow, a closure which is movable over the lid portion to open and close the outlet, and a push lever. The push lever includes a push arm, which when the push lever is in place on the server top and the push arm is pushed, pivots the push lever away from the opening; two sides of which a portion of each side is formed to be inwardly adjacent to one side face near its pivot hollow; two pivot protrusions, each of which extends outwardly from one push lever side to be received in the adjacent pivot hollow so that the push lever can be pivotally mounted between the two side faces, the push lever closure being connectable to the push lever so that when the lever pivots away from the outlet, the closure slides off from the outlet to allow passage therethrough, and when the lever pivots toward the outlet, the closure slides over the outlet to close the outlet. The entire push lever is injection molded as a unitary form finished push lever, with the push arm, two sides, and two protrusions formed in the same molding operation.

A primary object of the invention is to provide a server top which is attachable to a container, which requires no separate pivot pin for pivotally mounting the push lever so it may be used to open and close the server top outlet.

A second object of the invention is to provide a server top which is attachable to a container, in which the entire push lever is injection molded as a unitary form finished push lever with the push arm, two sides, and the two pivot protrusions formed in the same molding operation.

An additional object of the invention is to provide a server top which is attachable to a container, into which the snap-fit push lever may be installed by merely pushing the lever into place between the two handle side faces which extend outwardly from the lid portion of the server top.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
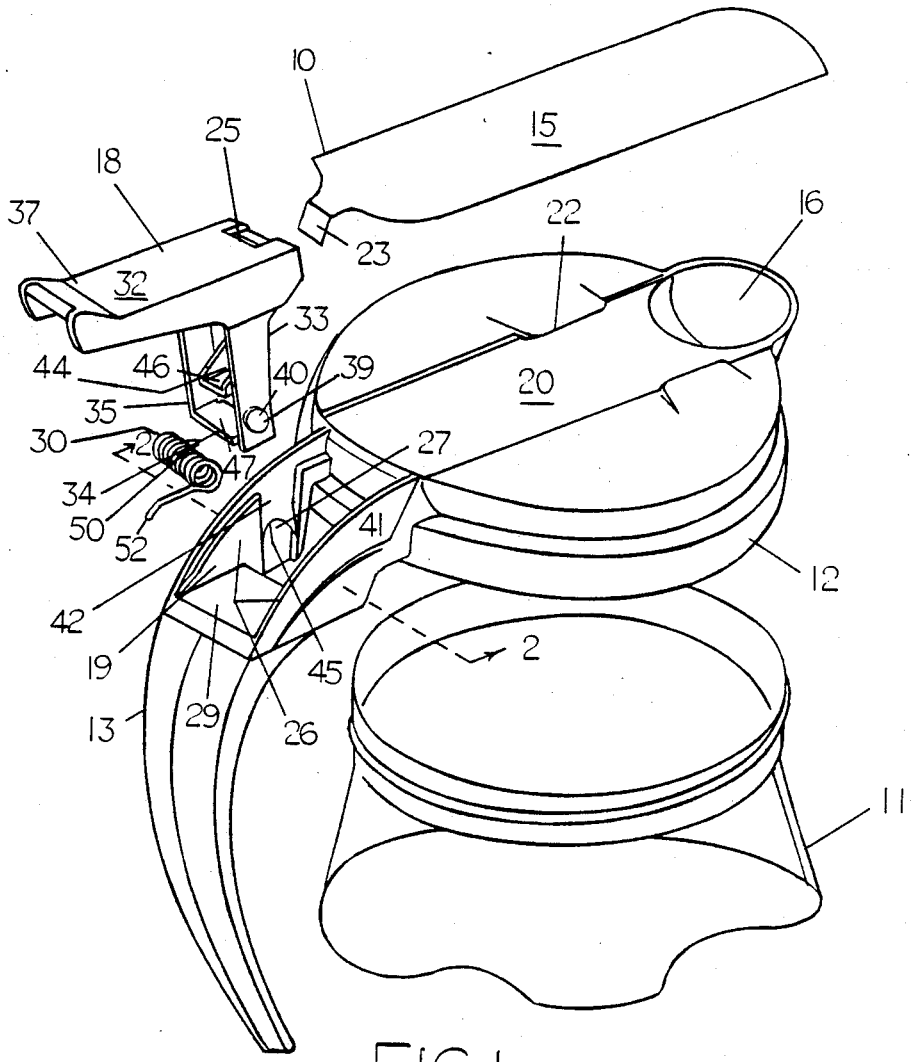
FIG. 1 is an exploded perspective view of the server top, showing the individual components thereof, and a container to which it may be attached.

Referring more particularly to the drawings, wherein like numbers refer to like parts, FIG. 1 shows in exploded perspective view a server top 10 which may be attached to the container 11. The server top 10 generally includes a lid portion 12 which fits over the container 11, a handle portion 13 which extends outwardly and downwardly from the lid portion 12, a closure 15 which moves over the lid portion 12 to open or close an outlet 16 within the lid portion 12, and a push lever 18 which is mounted within a cavity 19 in the handle portion 13, and which is pivotable to open or close the closure 15 over the outlet 16.

As shown in FIG. 1, the lid portion 12 has an outlet 16 through which a substance within the container 11, such as syrup, may be poured when open. The thin metallic sheet-like closure 15 is positioned and slidable forwardly and backwardly within a shallow groove 20 in the lid portion 12 to open and close the outlet 16. The closure 15 is held within the shallow groove 20 by the two tabs located at 22. The sheet like closure 15 includes the downwardly bent tab 23 which is insertable into a slit 25 in the push lever 18.

Figure 2:
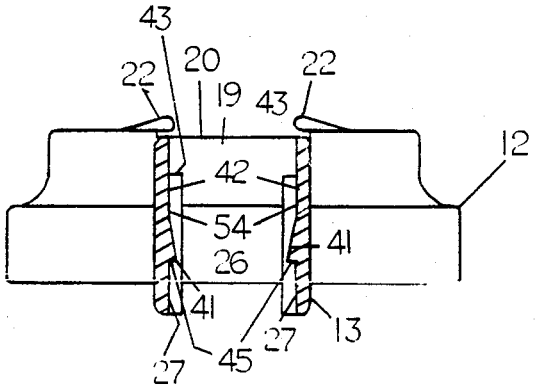
FIG. 2 is a cross-section view taken along section line 2—2 of FIG. 1.

The handle portion 13 includes two substantially parallel side faces 26 which each extend outwardly from the lid portion 12 and which each have formed therein a pivot hollow 27. The handle portion 13 furthermore includes a platform 29 which extends between the side faces 26 and forms a bearing surface for the spring 30, as shown in FIGS. 1 and 2. The side faces 26, the platform 29, and a portion of the lid portion 12 between the side faces 26 together form the cavity 19 in which the push lever 18 is mounted.

Figure 3:
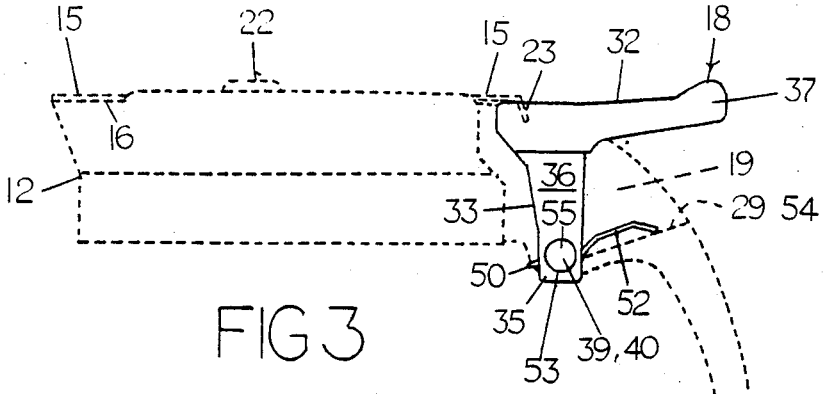
FIG. 3 is a side view of the push lever, showing the lid portion and handle portion of the server top in dashed lines.
Figure 4:
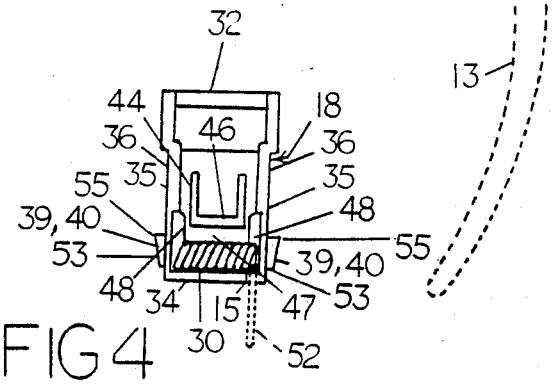
FIG. 4 is a rear view of the push lever, showing also the spring within the spring compartment.
Figure 5:
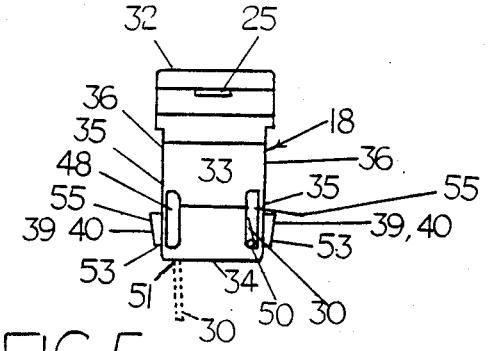
FIG. 5 is a front view of the push lever.

The push lever 18 includes a top wall 32; a front wall which extends downwardly, then diagonally rearwardly and downwardly, and then substantially downwardly from the top wall 32 to a bottom wall 34 as shown in FIGS. 2–4. The push lever 18 also includes two sides 36 which are connected to the top wall 32, front wall 33, and the bottom wall 34. As shown in FIGS. 3 and 4, a lower portion 35 of the side faces is stepped or indented inwardly so that the push lever can be inserted between the side faces 26. The slit 25 for receiving the downwardly bent tab 23 is located in the top wall 32 near where it joins with the front wall 33. A rear portion of the top wall 32 forms a push arm 37 which when pushed pivots the push lever 18 away from the outlet 16, and therefore pulls the closure 15 rearwardly to open the outlet 16.

When the push lever 18 is properly mounted between the side faces 26, the lower portions 35 of the push lever sides 36 are located immediately inwardly adjacent and parallel to the side faces 26. Near where each side 36 meets the bottom wall 34, one pivotal protrusion 39 extends outwardly from each push lever side 36 into the adjacent pivot hollow 27, so that the push lever 18 is pivotally mounted between the two side faces 26. Each pivot protrusion 39 includes an end 40 which is beveled inwardly from the upward direction to allow for ease in inserting the push lever 18 with its protrusions 39 between the side faces 26 from the upward direction.

Each of the two side faces 26 has formed therein an insertion groove 42 which extends from the upward edge 43 of the side face 26 downwardly to the pivot hollow 27 as shown in FIGS. 1 and 2. When the push lever 18 is being mounted within the cavity 19, the protrusions 39 are able to pass through these grooves 42 to their respective pivot hollows 27. Each groove has a ramp 41 leading to its pivot hollow 27. The ramp 41 includes a retaining face 45 which forms part of the pivot hollow 27 and which restrains the retained pivot protrusion 39 against upward movement out of the hollow 27. As shown in FIGS. 1 and 2, the pivot hollows 39 have no lower wall or face but instead are open. Such a face or wall is unnecessary, since the spring 30 maintains the pivot protrusions 39 against the corresponding retaining faces 45.

As shown in FIG. 3, a shelf 44 extends rearwardly from the front wall 33 of the push lever 18. A lower portion of the shelf 44 forms a wall 46 which together with the bottom wall 34, a portion of the front wall 33, and the sides 36 form a five-sided rectangular compartment 47 which is open on a sixth side to receive the spring 30. The front wall 33 has two vertical slots 48 adjacent to the bottom wall 34 and each of the two sides 36. The spring 30 is inserted into the compartment 47 such that a shorter end 50 of the spring 30 extends into one of the vertical slots 48 so that the spring is thereby restrained against loose rotation within the compartment by the push lever itself 18 as shown in FIG. 4. The bottom wall 34 has a horizontal slot 51 through which a longer end 52 of the unloaded spring 30 extends when the push lever 18 is not mounted within the cavity 19. When the push lever 18 is mounted in the cavity 19, the longer end 52 of the spring 30 must be pulled rearwardly to extend out the open sixth side of the compartment 47 to abut and be restrained against the platform so that the spring 30 is loaded. The placement of the longer end 52 of the spring 30 against the platform 29 biases the push lever 18 to pivot toward the outlet 16. Additionally, the placement of the end 52 of the spring 30 against the platform 29 causes the spring 30 to push upwardly against the shelf wall 46 to lift the push lever 18 and to cause the pivot protrusions 39 to press against the corresponding retaining faces 45. The three walls, 33, 34 and 46 which form the compartment 47 extend substantially between the push lever sides 36 near the pivot protrusions 39 such that the spring 30 when placed within the compartment 47, has a common axis with the pivot protrusions 39. The entire push lever 18 is injection molded as a unitary form finished push lever 18, with the push arm 37, two sides 36, and two protrusions 39 formed in the same molding operation.

In its operation, the server top 10 of FIG. 1 is attached to a container 11 such as a jar of syrup so that the syrup may be controllably dispensed through the outlet 16. The entire push lever 18 including the protrusions 39 is formed in a single molding operation and therefore does not require a separate pivot pin for mounting. To prepare the push lever 18 for installation within the handle cavity 19, the spring 30 should be placed into the compartment 47 such that the shorter end 50 of the spring 30 extends into one of the vertical slots 48 to be thereby restrained against the push lever, and the longer end 52 of the spring 30 extends downwardly through the horizontal slot since the spring 30 is unloaded. To insert the push lever 18 into the cavity 19, the longer end 52 of the spring 30 should be pulled rearwardly, extending out through the open sixth side of the compartment 47 so that the spring 30 is loaded. The push lever 18 is placed over the cavity 19 and pushed downwardly so that the pivot protrusions 39 enter their respective insertion grooves 42 and are slid downwardly into the pivot hollows 27. When the push lever 18 is being inserted into the cavity 19, the pivot protrusions 39 are able to enter their respective insertion grooves because the distance between the foot 53 of one protrusion beveled end 40 to the foot 53 of the other protrusion beveled end 40 is less than the distance between the floors 54 of the two insertion grooves 42. Once the pivot protrusions 30 are properly mounted within the pivot hollows 27, the protrusions 39 are retained therein because the distance from the crown 55 of one protrusion beveled end 40 to the crown 55 of the other protrusion beveled end 40 is greater than the least distance between the ramps 41 of the insertion grooves 42 in the side faces 26.

Once the push lever 18 is mounted properly within the cavity 19, the longer end 52 of the loaded spring 30 rests on the platform 29 so that the push lever 18 is biased to pivot upwardly toward the outlet 16. The server top 10 is then placed on a container 11 full of a flowable substance such as syrup. When the container is lifted and tilted forwardly by the handle portion 13, and the push arm 37 is pushed downwardly so that it pivots away from the outlet 16 and pulls the closure 15 off the outlet 16, the substance flows out through the outlet 16. The flow may be halted by lessening pressure upon the push arm 37 so that the spring 30 pivots the push lever 18 toward the outlet which is then closed by the closure 15.

Figure 6:
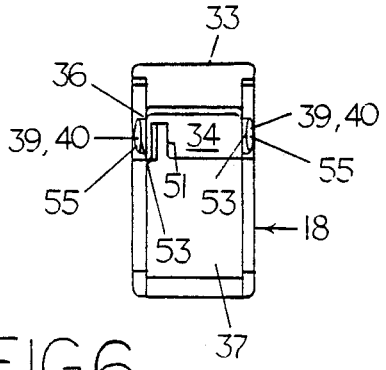
FIG. 6 is a bottom view of the push lever.

As shown in FIG. 6, each insertion groove 42 starts at an upward edge 43 of a side face 26 and extends to the pivot hollow 27. Alternatively, the insertion grooves 42 may extend to the pivot hollows 27 from a direction other than the upward direction. In such an alternative embodiment, the direction of beveling on the pivot protrusion ends 40 would be changed so that the push lever 18 could be inserted into the cavity 19 with the protrusions 39 moving through the insertion grooves 42 to the pivot hollows 27. For example, if the insertion grooves extended from a rearward direction to the pivot hollows 27, the pivot protrusion ends 40 would be beveled inwardly from a rearward direction. The pivot hollows 27, as shown in FIGS. 1–2, are downwardly open and extend only part way through the side faces 26. Alternatively, they could be some other shape, such as entirely circular, and might extend all the way through the side faces 26.

It is to be understood that the present invention is not limited to the particular arrangement and embodiments of arts disclosed and illustrated herein, nor to the materials specified, but embraces all such modified forms thereof as come within the scope of the following claims.

What is claimed is:

1. A server top which is attachable to a container, comprising:

(a) a lid portion which fits over the container and which has an outlet therethrough through which a substance within the container may be poured;

(b) two substantially parallel side faces which each extend outwardly form the lid portion and which each have a pivot hollow;

(c) a closure which is movable over the lid portion to open and close the outlet;

(d) a push lever including: a push arm which when pushed, pivots the push lever away from the outlet; two push lever sides each of which has a portion adjacent to one side face near its pivot hollow; two pivot protrusions, each of which extends outwardly from one push lever side into the adjacent pivot hollow so that the push lever is pivotally mounted between the two side faces, the closure being connected to the push lever so that when the lever pivots away from the outlet, the closure slides off from the outlet to allow passage therethrough and when the lever pivots toward the outlet, the closure slides over the outlet to close the outlet, the entire push lever being injection molded as a unitary push lever, with the push arm, two sides, and two protrusions formed in the same molding operation;

(e) a coil spring including two ends for biasing the push lever to pivot toward the outlet;

(f) a bearing surface which is substantially perpendicular to and located between the side faces; and (g) the push lever further including three walls which each extend substantially between the perpendicular to the push lever sides, the three walls joined together at their edges and with the push lever sides forming a five sided rectangular compartment which is open on a sixth side to receive the spring, the spring being substantially contained and held within the compartment between the push lever sides, one of the three walls having a slot into which one of the spring ends fits and is thereby restrained against the push lever, the other spring end extending out the open sixth side of the compartment to abut and be restrained against the bearing surface to bias the push lever toward the outlet.

2. The server top of claim 1 wherein the three walls extend substantially between the push lever sides near the pivot protrusions such that the spring when placed within said compartment has a common axis with the pivot protrusions.

3. A push lever for use in opening and closing over an outlet on a server top having two substantially parallel side faces which each extend outwardly from a lid portion of the server top and which each have a pivot hollow, the push lever comprising;

a push arm which when the push lever is in place on the server top and the push arm is pushed, pivots the push lever away from the outlet;

a pair of sides on the push lever extending from the push arm to be adjacent to the pivot hollows on the side faces of the server top;

two pivot protrusions, each one of which extends outwardly from one push lever side to be received in the adjacent pivot hollow so that the push lever can be pivotally mounted between the two side faces, the push lever and the closure being connectable so that when the lever pivots away from the outlet, the closure slides off from the outlet to allow passage therethrough, and when the lever pivots toward the outlet, the closure slides over the outlet to close the outlet, the entire push lever, with the push arm, two sides, and two protrusions formed in the same molding operation;

three walls which each extend substantially between and perpendicular to the push lever sides, the three walls joined together at their edges and with the push lever sides forming a five sided rectangular compartment for a spring and which is open on the sixth side so that the spring can be placed therein, one of the three walls having a slot into which a spring end can fit and thereby be restrained against the push lever while another spring end can extend out through the open sixth side of the compartment to abut and be restrained against the server top to bias the push lever toward the server top outlet.

4. The push lever of claim 3 wherein the three walls extend substantially between the push lever sides near the pivot protrusions such that the spring when placed within said compartment has a common axis with the pivot protrusions.

* * * * *